US010835092B2

(12) United States Patent
O'Neill

(10) Patent No.: US 10,835,092 B2
(45) Date of Patent: Nov. 17, 2020

(54) VACUUM CLEANER ATTACHMENT HAVING A CONCAVE VACUUM HEAD WITH A SWIVEL JOINT THAT SWIVELS ONLY WITHIN A CENTRAL PLANE OF THE VACUUM HEAD

(71) Applicant: Patricia Ann O'Neill, Bergland, MI (US)

(72) Inventor: Patricia Ann O'Neill, Bergland, MI (US)

( * ) Notice: Subject to any disclaimer, the term of this patent is extended or adjusted under 35 U.S.C. 154(b) by 0 days.

(21) Appl. No.: 16/678,251

(22) Filed: Nov. 8, 2019

(65) Prior Publication Data

US 2020/0085268 A1 Mar. 19, 2020

Related U.S. Application Data

(63) Continuation of application No. 15/421,511, filed on Feb. 1, 2017, now abandoned.

(60) Provisional application No. 62/289,392, filed on Feb. 1, 2016.

(51) Int. Cl.
*A47L 9/06* (2006.01)

(52) U.S. Cl.
CPC ..... *A47L 9/0693* (2013.01); *A47L 9/062* (2013.01)

(58) Field of Classification Search
CPC ..... A47L 9/0693; A47L 9/062; A47L 9/02
See application file for complete search history.

(56) References Cited

U.S. PATENT DOCUMENTS 2,686,330 A 8/1954 Wales
2,854,683 A 10/1958 Warden
4,615,802 A 10/1986 Harbaugh
(Continued)

FOREIGN PATENT DOCUMENTS

DE 3546340 A1 7/1987
EP 1714599 A1 4/2005
(Continued)

OTHER PUBLICATIONS

Website: https://www.solidrop.net/product/vacuum-cleaning-accessories-brush-head-gray-plastic-metal-for-dyson-dc35-dc34-dc31-motorized-floor-tool-vacuum-cleaner-head.html Downloaded Nov. 12, 2017 Vacuum Cleaning Accessories Brush Head Gray Plastic+Metal for Dyson Dc35 Dc34 Dc31 Motorized Floor Tool Vacuum Cleaner Head.

(Continued)

*Primary Examiner* — David Redding
(74) *Attorney, Agent, or Firm* — Russ Weinzimmer & Associates, P.C.

(57) ABSTRACT

A vacuum cleaner attachment is disclosed having a concave vacuum head with a swivel joint that permits swiveling of the vacuum head only within the plane of the vacuum head. The concave vacuum head can have a curvature that is similar to the curvature of a cylindrical surface to be vacuumed. Thus, while a user manipulates the conduit providing the air suction to the vacuum head, the concave surface can be supported and swiveled around the circumference of the cylindrical surface to be vacuumed, while the vacuum head is also moved along the length of the cylindrical surface. Throughout this movement of the concave vacuum head, the concave opening of the concave vacuum head can stay in closer proximity and conformity to the cylindrical surface than is possible using a fixed vacuum (Continued)

head with a flat opening, thereby making cleaning of the cylindrical surface more effective and efficient.

4 Claims, 6 Drawing Sheets

(56) References Cited

U.S. PATENT DOCUMENTS

| | | | |
|---|---|---|---|
| 4,696,076 | A | 9/1987 | Ahlf et al. |
| 5,412,837 | A | 5/1995 | Worwag |
| 5,652,996 | A | 8/1997 | Moine et al. |
| 5,690,545 | A | 11/1997 | Clowers et al. |
| 5,781,960 | A | 7/1998 | Kilstrom et al. |
| 6,038,732 | A | 3/2000 | McKnight et al. |
| 6,581,974 | B1 | 6/2003 | Ragner et al. |
| 6,920,665 | B2 | 7/2005 | Tucker |
| D624,156 | S | 9/2010 | Leber |
| 8,171,600 | B2 | 5/2012 | Draper et al. |
| 8,707,508 | B2 | 4/2014 | Dyson et al. |
| 8,789,238 | B2 | 7/2014 | Myers |
| 2005/0066471 | A1 | 3/2005 | Miller et al. |
| 2013/0315653 | A1 | 11/2013 | Jalbert |
| 2014/0033468 | A1 | 2/2014 | Guder et al. |
| 2014/0261837 | A1 | 9/2014 | van der Meijden et al. |

FOREIGN PATENT DOCUMENTS

| | | | |
|---|---|---|---|
| GB | 2076540 | A | 12/1981 |
| WO | 2017017365 | A1 | 2/2017 |
| WO | 2017106900 | A1 | 6/2017 |

OTHER PUBLICATIONS

Website: http://www.dysoncanada.ca/en-CA/vacuum-cleaners/upright/dyson-small-ball.aspx Downloaded Nov. 12, 2017 A ball steering mechanism means you can easily maneuver the Dyson Small Ball vacuum around corners.

VACUUM CLEANER ATTACHMENT HAVING A CONCAVE VACUUM HEAD WITH A SWIVEL JOINT THAT SWIVELS ONLY WITHIN A CENTRAL PLANE OF THE VACUUM HEAD

CROSS-REFERENCE TO RELATED APPLICATIONS

This application is a Continuation of patent application Ser. No. 15/421,511 filed Feb. 1, 2017, which is based on the Provisional Application Ser. No. 62/289,392 filed Feb. 1, 2016, the entire contents of which is herein incorporated by reference.

FIELD OF THE INVENTION

This invention relates generally to vacuum cleaner attachments, and more particularly to vacuum cleaner attachments having a concave vacuum head.

BACKGROUND OF THE INVENTION

Many attachments for vacuum cleaners have a flat opening for cleaning the many flat surfaces commonly found in homes and offices. A different situation exists when the surface to be vacuumed is cylindrical or otherwise curved. In such cases, the flat opening fails to get sufficient simultaneous proximity and conformity to the curved surface of the cylinder (e.g., a log, a pipe, a round post), substantially reducing the ability of the attachment to use suction to clean the surface.

Recently, it was estimated that there are over 450,000 log homes in the United States, with more being built each year. Many have at least some interior walls with exposed log surfaces. It can be very difficult to keep these exposed log surfaces clean and dust free using vacuum attachments with flat openings for at least the aforementioned reason.

Aside from using a vacuum cleaner, other existing cleaning methods fall short of providing satisfactory removal of dust and other debris from the log surfaces. For example, a brush on an extension pole does little more than move the dust from the logs to the furnishings or floors below. Dust rags and cloths catch on the rough surfaces of exposed logs, leaving rag particles behind that create a mess on the log rather than removing the dust.

SUMMARY OF THE INVENTION

A general aspect of the invention is an apparatus for attachment to a vacuum cleaner. The apparatus includes: a vacuum head, the vacuum head including a concave opening having a concave curvature corresponding to a convex curvature of a cylindrical surface to be vacuumed; and an attachment mechanism configured to support the vacuum head and configured to provide suction generated by the vacuum cleaner to the vacuum head.

In some embodiments, the cylindrical surface that is to be vacuumed is one of: a log, a pipe, a post, a beam.

In some embodiments, the attachment mechanism includes a swivel joint that swivels only within a central plane of the vacuum head.

In some embodiments, the attachment mechanism includes a swivel joint that includes a bendable hose for providing suction to the vacuum head in any swivel position.

In some embodiments, the vacuum head includes a plurality of bristles disposed at the concave opening of the vacuum head. In further embodiments, the plurality of bristles are disposed at acute angles with respect to the concave opening of the vacuum head. In other further embodiments, the plurality of bristles are disposed at an angle of about 45° with respect to the concave opening of the vacuum head.

In some embodiments, the concave opening has a curvature corresponding to a convex surface with a cylindrical curvature having a radius between approximately 6 inches and approximately 12 inches.

Another general aspect of the invention is an apparatus for attachment to a vacuum cleaner, this apparatus including: a vacuum head including a concave opening having a curvature that generally corresponds to the convex curvature of a surface to be vacuumed, the vacuum head being symmetrical about a central plane that bisects the vacuum head; a swivel joint having a first section in fixed engagement with the vacuum head, and a second section that is in swivelable relationship with the first section, the swivel joint being configured to swivel only through the central plane of the vacuum head; and a flexible conduit extending from the first section to the second section, the flexible conduit being configured to provide suction generated by the vacuum cleaner to the vacuum head.

In some embodiments, the first section includes a neck extending therefrom for connection to a further conduit.

In some embodiments, the first section of the swivel joint includes a sphere having an annular opening for supporting an end of the conduit, the sphere further having an arcuate passageway; and the second section of the swivel joint includes a carriage mounted for swiveling within the sphere, wherein the neck is in fixed alignment for swiveling with the carriage, and wherein the neck extends through the arcuate passageway and is movable with the carriage as the carriage swivels with respect to the sphere.

In some embodiments, the carriage includes a rail, and the sphere includes a track configured to engage the rail, wherein movement of the rail along the track allows the carriage to rotate within the sphere.

In some embodiments, the carriage includes at least two rails disposed at opposite sides of the neck, wherein the sphere includes at least two tracks respectively engaging the at least two rails, and wherein movement of the at least two rails along the at least two tracks allows the carriage to swivel within the sphere.

In some embodiments, the sphere includes: a first hemisphere fixed to the vacuum head, the first hemisphere including the annular opening; and a second hemisphere fixed to the first hemisphere, the second hemisphere including the arcuate passageway.

In some embodiments, the first and second hemispheres include overlapping peripheral edges.

In some embodiments, the vacuum head includes a plurality of bristles disposed at the concave opening of the vacuum head. In further embodiments, the plurality of bristles are disposed at acute angles with respect to the concave opening of the vacuum head. In still further embodiments, the plurality of bristles are disposed at an angle of about 45° with respect to the concave opening of the vacuum head.

In some embodiments, the concave surface has a curvature corresponding to a convex surface of a log having a radius of between approximately 6 inches and approximately 12 inches.

Another general aspect of the invention is an apparatus for attachment to a vacuum cleaner, this apparatus including: a vacuum head including a concave opening having a curvature generally corresponding to a convex curvature of a surface to be vacuumed; a sphere including a first hemisphere fixed to the vacuum head, and a second hemisphere fixed to the first hemisphere, the first hemisphere having an annular opening, the second hemisphere having an arcuate passageway, attachment of the first and second hemispheres forming a track along an interior surface of the sphere; a carriage having a neck configured to extend through the arcuate passageway, the carriage including a rail configured to engage the track so as to allow the carriage to swivel within the sphere, and to allow the neck to move along the arcuate passageway; and a conduit extending between the annular opening of the first hemisphere and the neck so as to provide fluid communication of suction between the vacuum head and the vacuum cleaner.

Yet another general aspect of the invention is an apparatus for attachment to a vacuum cleaner. The apparatus includes a vacuum head. The vacuum head includes: a concave opening having a concave curvature corresponding to a convex curvature of a cylindrical surface to be vacuumed, an arcuate slot opposite to the concave opening, a circular track co-extensive with the arcuate slot, and an inlet configured to be in fluid communication with both a source of vacuum suction and the concave opening so as to provide vacuum suction to the concave opening; a flexible conduit connected in fluid communication at a first end with the inlet of the vacuum head; and an attachment mechanism configured to swivelably support the vacuum head so as to swivel only within a central plane of the vacuum head, and configured to provide suction generated by the vacuum cleaner to the vacuum head. The attachment mechanism includes: a neck having a flange end configured to receive a source of vacuum suction, an inlet end configured to receive a second end of the flexible conduit, and at least one annular rail attached to the neck between the flange end and the inlet end, the annular rail configured to slidably engage with the circular track of the vacuum head such that movement of the annular rail along the circular track allows the neck to move through the arcuate slot of the vacuum head, thereby enabling the concave opening of the vacuum head to be supported and swiveled around the convex curvature of the cylindrical surface to be vacuumed, while the vacuum head is also moved along the length of the cylindrical surface to be vacuumed.

In some embodiments, the flange end of the neck is configured to receive a source of vacuum suction for providing suction to the vacuum head as the vacuum head is swiveled around the convex curvature of the cylindrical surface to be vacuumed.

Still another general aspect of the invention is an apparatus for attachment to a vacuum cleaner. This apparatus includes a vacuum head that is symmetrical about a central plane that bisects the vacuum head. The vacuum head includes: a concave opening having a curvature that generally corresponds to the convex curvature of a surface to be vacuumed, an arcuate slot opposite to the concave opening, and a circular track co-extensive with the arcuate slot; a swivel joint having a first section with an inlet in fixed engagement with the vacuum head, the inlet configured to be in fluid communication with both a source of vacuum suction and the concave opening so as to provide vacuum suction to the concave opening, the swivel joint also having a second section that is configured to be in swivelable relationship with the first section, the swivel joint being configured to swivel only through the central plane of the vacuum head. The second section of the swivel joint includes: a neck having a flange end configured to receive a source of vacuum suction, an inlet end configured to receive an end of a flexible conduit, and at least one annular rail attached to the neck between the flange end and the inlet end, the annular rail configured to slidably engage with the circular track of the vacuum head such that movement of the annular rail along the circular track allows the neck to move through the arcuate slot of the vacuum head; and a flexible conduit extending from the first section to the second section, the flexible conduit being configured to provide suction generated by the source of vacuum suction to the vacuum head.

In some embodiments, the neck has a second annular rail attached on an opposite side of the neck.

BRIEF DESCRIPTION OF THE DRAWINGS

The invention will be more fully understood by reference to the detailed description in conjunction with the following figures.

DETAILED DESCRIPTION OF PREFERRED EMBODIMENTS

Figure 1:
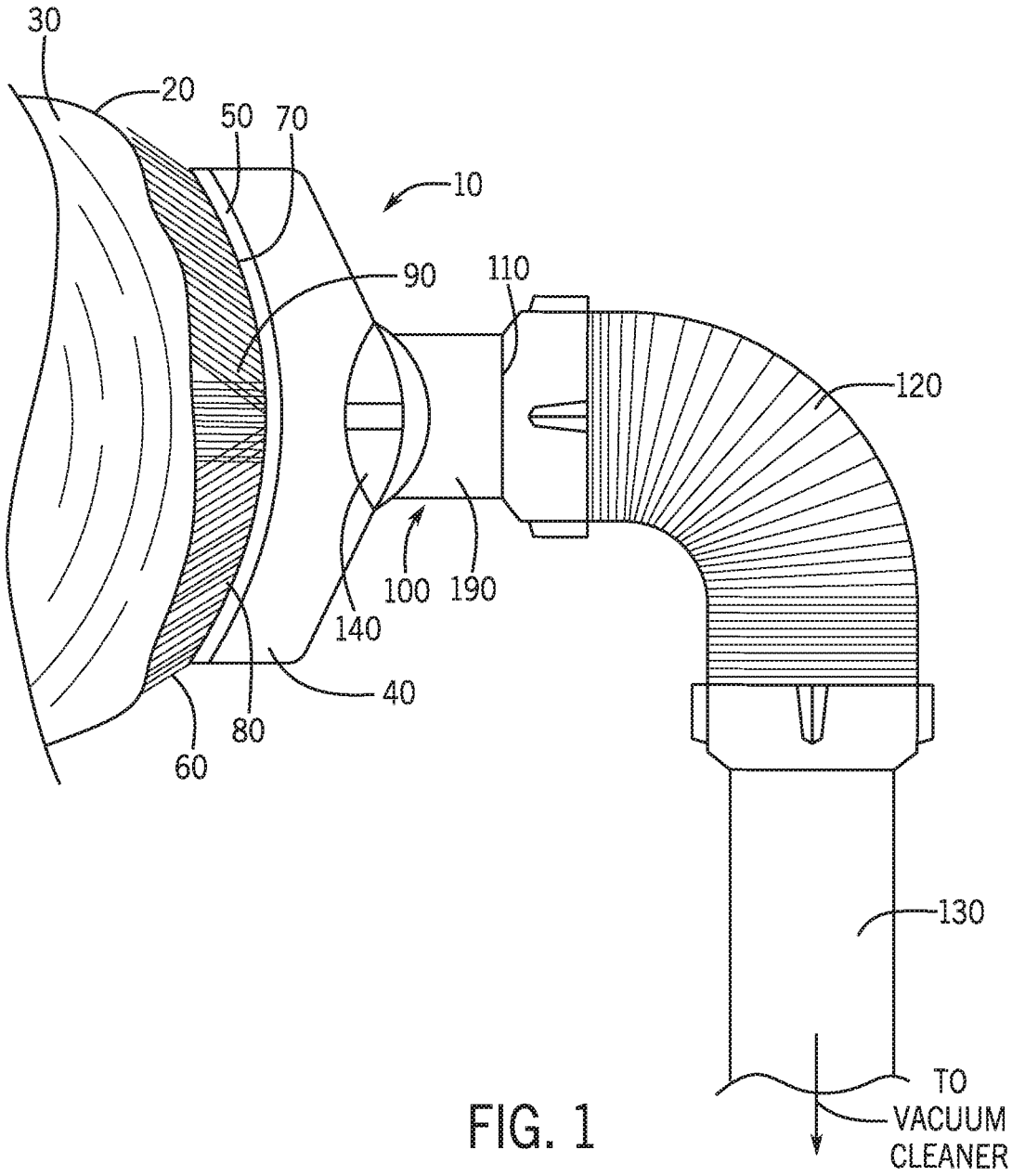
FIG. 1 is a side view of an embodiment of a vacuum system including a vacuum cleaner attachment for cleaning cylindrical surfaces, such as a log.

FIG. 1 shows one embodiment of a vacuum system including a vacuum cleaner attachment 10 having a concave opening 50 for cleaning a cylindrical surface 20. For this example, it is assumed that the cylindrical surface 20 is an exterior surface of a log 30, such as one used in building a log cabin.

As shown, the vacuum cleaner attachment 10 includes a vacuum head 40 having a concave opening 50. The concave contour of the concave opening 50 corresponds to the cylindrical contour of surface 20 of the log 30. Common building logs have a radius of between approximately 6 inches to approximately 12 inches. The concave contour of the concave opening 50 of the particular vacuum head 40 can be chosen to accommodate curved objects having various other radii. There may be situations in which a single convex contour of the vacuum head 40 can effectively accommodate a range of different cylindrical surface radii. Alternatively, a user may elect to employ different vacuum heads, each different vacuum head having an opening with a concave contour radius that matches the radius of the cylindrical surface to be cleaned.

The vacuum head 40 may include a plurality of bristles disposed at the concave opening 50 to adapt to a range of cylindrical radii. The bristles 60 at a first portion 70 of the concave opening 50 may advantageously extend at an acute angle of about 45° in a first direction, while the bristles 60 at a second portion 80 of the concave opening 50 may extend at an acute angle of about 45° in a second direction. The bristles 60 proximate to a third portion 90 of the concave opening 50 may, for example, extend generally perpendicular to the surface.

The vacuum head 40 of the vacuum cleaner attachment 10 may include an attachment mechanism 100 that supports the vacuum head 40. The attachment mechanism 100 is configured to provide one or more fluid flow channels between one or more components connected to a vacuum cleaner and one or more vacuum openings at the concave opening 50. Here, the outlet 110 of the attachment mechanism 100 is attached to the vacuum cleaner through a flexible hose 120 and rigid pole 130. Other components, however, may be used in addition to, or in lieu of, those shown in FIG. 1.

In one example, the attachment mechanism 100 may include a swivel joint, shown generally at 140 of FIG. 1. The swivel joint 140 may be configured to generally limit swiveling of the vacuum head to a single central plane, such as the central plane defined by the central seam 170 (see FIGS. 2 and 3). When the concave opening 50 has an arc length less than the arc length of the convex surface of, for example, a log, the vacuum head is easily swiveled to various angles about the circumference of the log. In this manner, the concave opening 50 is maintained in close proximity and conformity to the cylindrical surface of the log as the vacuum head is swiveled around the circumference of the log, while the vacuum head is moved along the length of the log. Various views of the vacuum head 40 and swivel joint 140 are shown in FIGS. 2-4, where the bristles 60 are not shown to enhance clarity.

Figure 2:
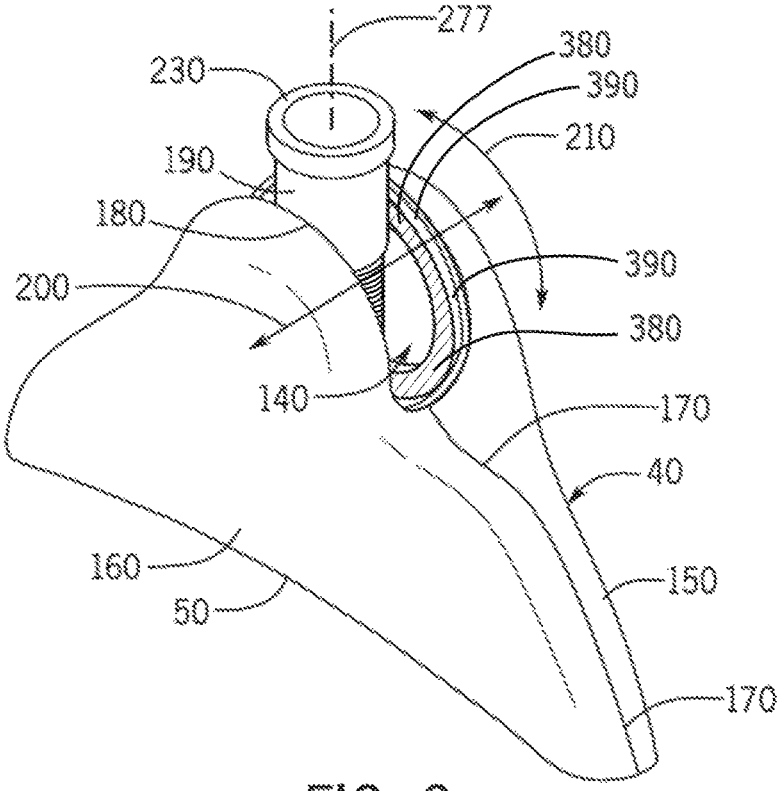
FIG. 2 is a top perspective view of the embodiment of the vacuum cleaner attachment of FIG. 1.

Referring to FIG. 2, the vacuum head 40 includes a first shell 150 and a second shell 160. The first and second shells 150 and 160 are joined with one another along the central seam 170, and support various components of the swivel joint 140. An upper portion of the vacuum head 40 is open and defines an arcuate slot 180, which allows a neck of the swivel joint 140 to move through the central plane defined by the central seam 170 about a rotation axis 200 in the direction shown by arrows 210.

Figure 3:
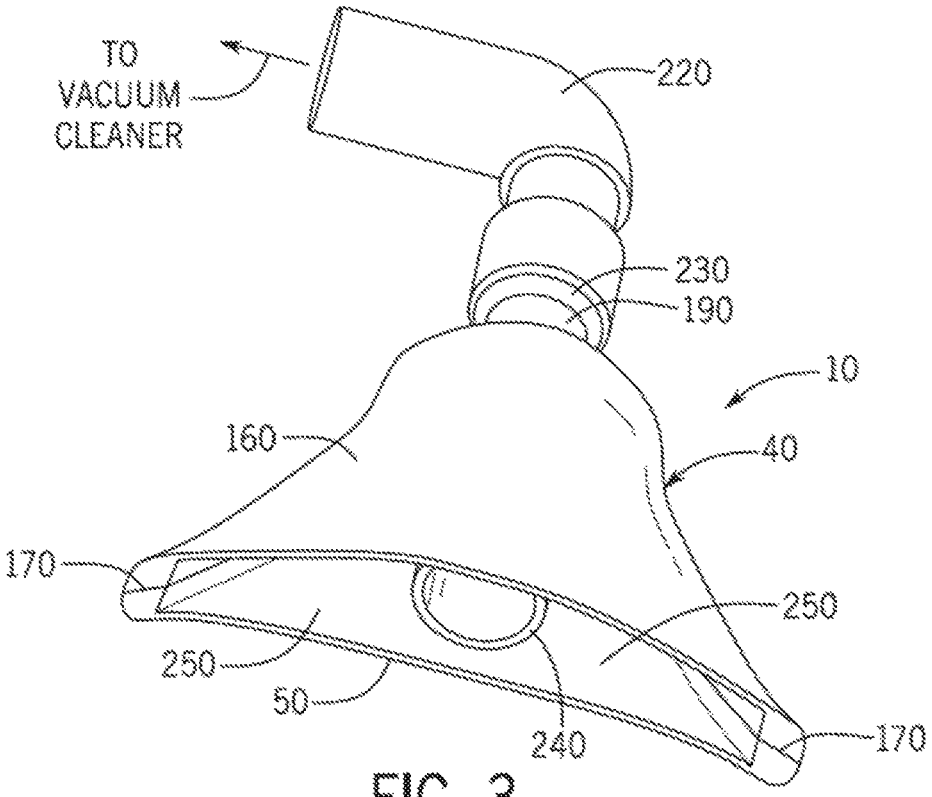
FIG. 3 is a bottom perspective view of the embodiment of the vacuum cleaner attachment of FIG. 1.

FIG. 3 is a bottom perspective view of the vacuum cleaner attachment 10. In this view, a conduit 220, in the form of a rigid elbow, is connected to a flange 230 of the neck 190. The bottom portion of the swivel joint 140 includes an inlet 240 that opens to a vacuum chamber 250. The bottom portion of the vacuum chamber 250, in turn, has lower edges defined by the concave opening 50. FIG. 3 also shows another view of the seam 170 joining the first and second shells 150 and 160.

Figure 4:
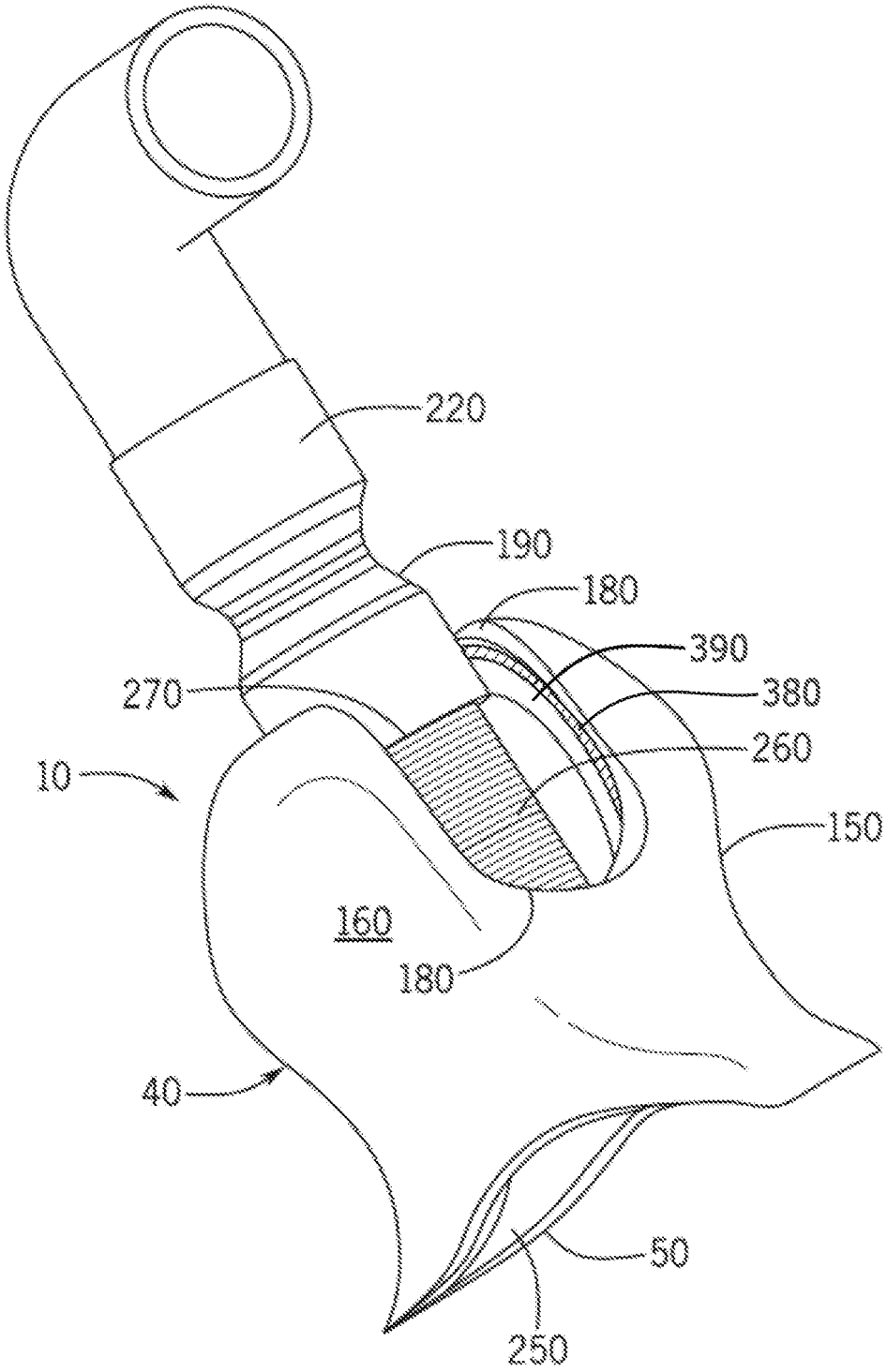
FIG. 4 is an edge-on perspective view of the embodiment of the vacuum cleaner attachment of FIG. 1.

FIG. 4 is bottom perspective view of the vacuum cleaner attachment 10 with the conduit 220 attached to the neck 190. In this embodiment, a conduit 260, shown here as a flexible tube, provides fluid communication for suction between the inlet 240 of the swivel joint 140 and an inlet 270 of the neck 190.

Figure 5:
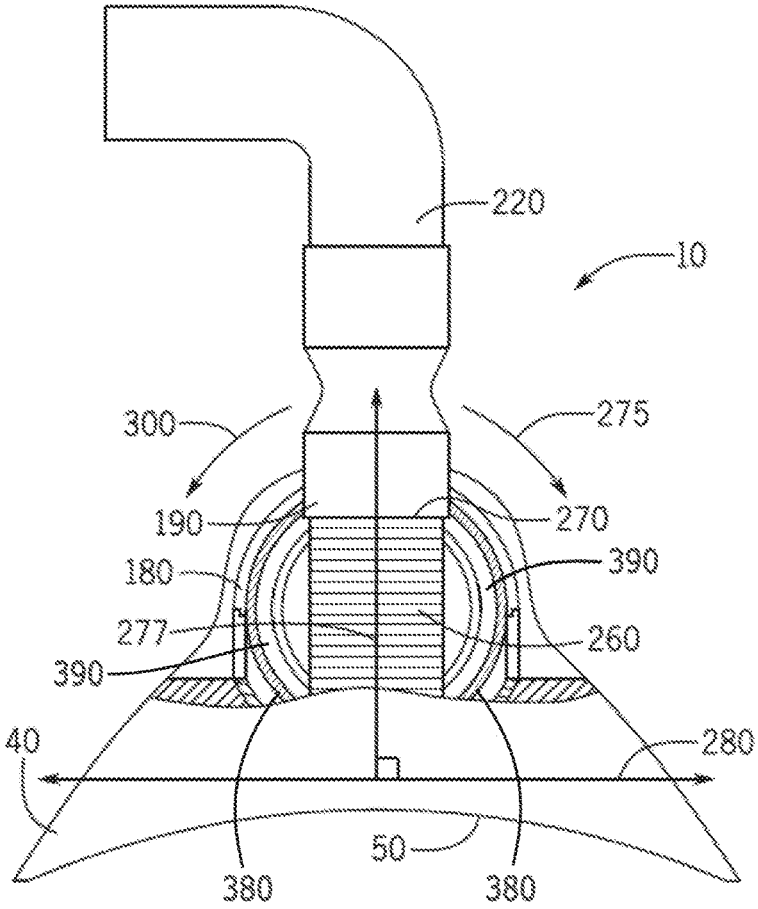
FIG. 5 is a partial cut-away side view of one embodiment of the vacuum cleaner attachment where a neck of the vacuum cleaner attachment is swiveled within the central plane of the vacuum head into perpendicular relationship with a longitudinal axis of the vacuum head.
Figure 6:
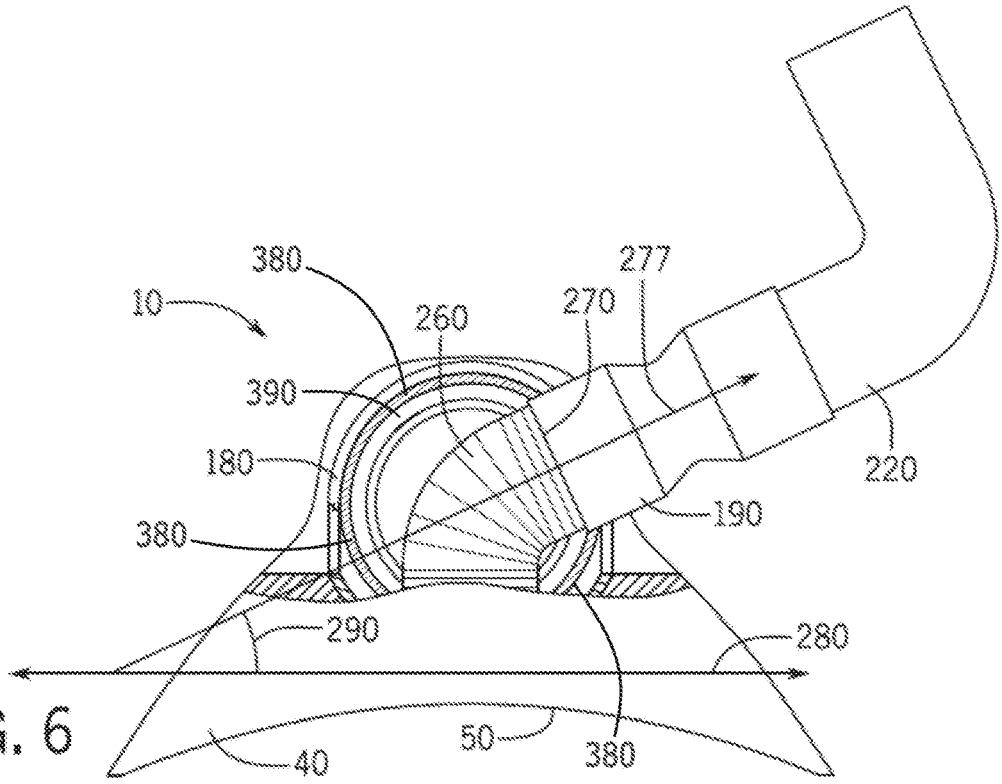
FIG. 6 is a partial cut-away side view of the embodiment of FIG. 5 where the neck of the vacuum cleaner attachment is swiveled within the central plane of the vacuum head to make an acute angle with respect to the longitudinal axis of the vacuum head.
Figure 7:
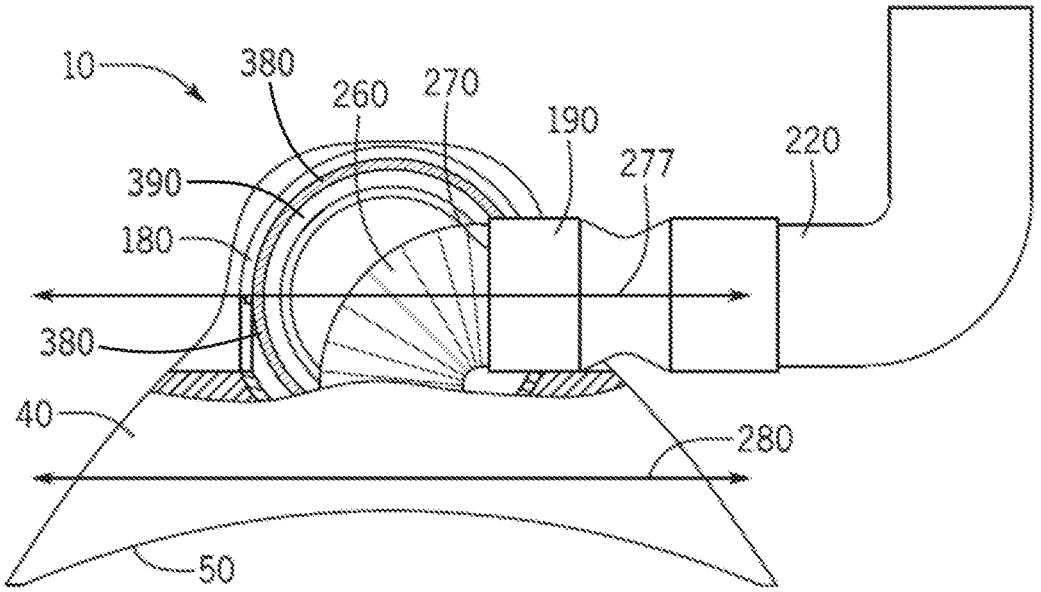
FIG. 7 is a partial cut away side view of the embodiment of the FIG. 5 where the neck of the vacuum cleaner attachment is swiveled within the central plane of the vacuum head to become substantially parallel to the longitudinal axis of the vacuum head.

FIGS. 5-7 show the neck 190 at various positions as it swivels through various positions along the arcuate slot 180 in the direction shown by arrow 275. Here, the arcuate passageway 370 is coplanar with the longitudinal axis 280 of the vacuum head 40 so that any swivel movement of the neck 190 is generally limited to lie within that plane.

FIGS. 5-7 show a central axis 277 of the neck 190 that is coplanar with the longitudinal axis 280 and the central plane defined by the central seam 170. In FIG. 5, the central axis 277 is approximately perpendicular to the longitudinal axis 280. In FIG. 6, the neck 190 has been swiveled to a position at which the central axis 277 is at an angle 290 with respect to the longitudinal axis 280 and in the same plane as the central axis 277. In FIG. 7, the neck 190 has been swiveled to an orientation at which the central axis 277 is approximately parallel to the longitudinal axis 280 and in the same plane as the central axis 277 and the central plane defined by the central seam 170. The neck 190 may also be swiveled in the direction of arrow 300 (FIG. 5) to positions at which the central axis 277 lies at various angles with respect to the longitudinal axis 280. Since the conduit 260 is flexible, the neck 190 and vacuum head 40 may be rotated with respect one another without substantially inhibiting the suction needed to clean the surface being vacuumed.

Rotation of the neck 190 with respect to the longitudinal axis 280 allows the user to engage rounded surfaces of convex objects, such as logs, at various angles. This makes it easier to vacuum surfaces such as those found on logs that are stacked on one another in a log home. Further, in instances in which the concave opening of the vacuum head has an arc length less than half of the circumference of the surface of the log, the vacuum head can be swiveled to vacuum most of the circumference of the log, while maintaining the concave opening in close proximity and conformity to the convex cylindrical surface of the log while the vacuum head is also moved along the length of the log.

Figure 8:
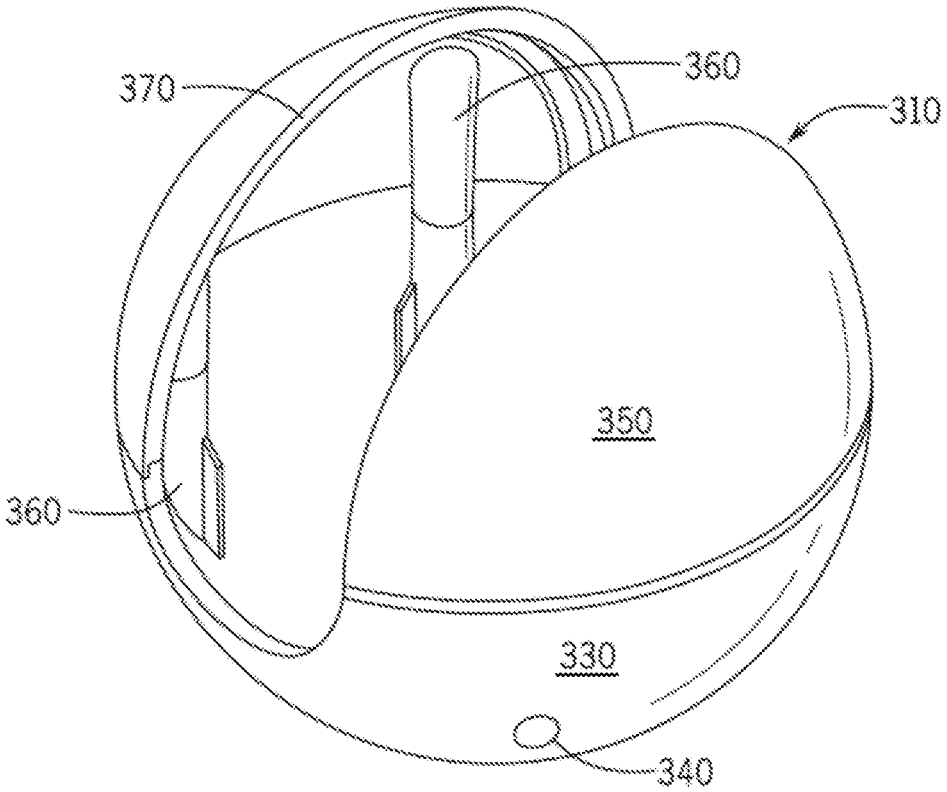
FIG. 8 is a perspective view of an embodiment of a mounting member that can be used in an embodiment a swivel joint, where the mounting member is in the form of a hollow sphere having spherical interior surfaces.
Figure 9:
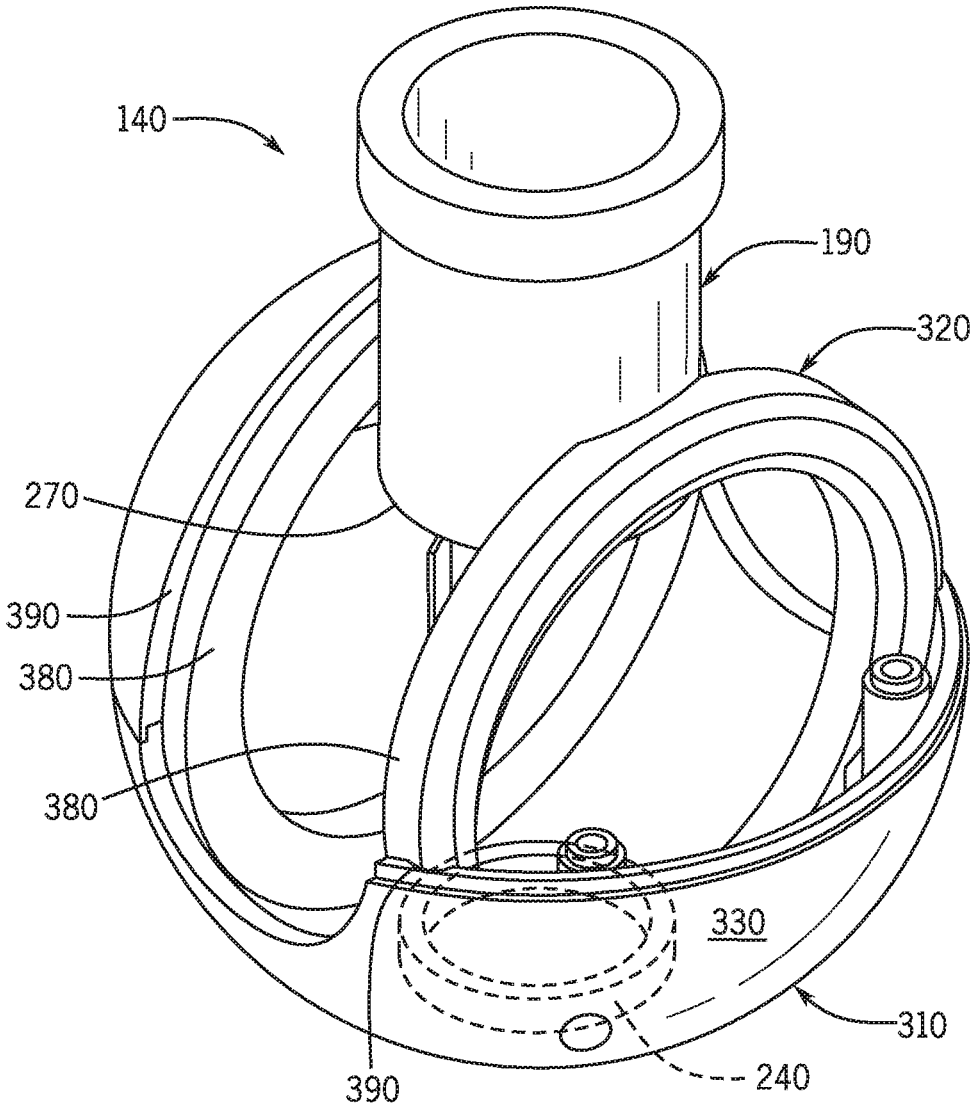
FIG. 9 is a partial cut-away view of one embodiment of the swivel joint showing a carriage mounted for swiveling within the hollow sphere of FIG. 8.

In one embodiment, the swivel joint 140 includes a carriage mounted for rotational movement within a mounting member having a spherical interior surface. For ease of manufacture, the exterior of the mounting member may also be spherical. Although the term "sphere" is used with reference to the mounting member, it is to be understood that the term also applies to any shaped mounting member in which the interior surfaces are spherical. FIG. 8 shows one example of such a sphere 310, where the sphere 130 is substantially hollow so that it is light-weight and limits the amount of material needed to manufacture it. FIG. 9 is a partial cut away view of the swivel joint 140 showing one example of a carriage 320 mounted for swiveling within the sphere 310.

Referring to FIG. 8, the sphere 310 may include a first hemisphere 330 fixed to the vacuum head 40. The first hemisphere 330 may be fixed to the vacuum head 40 using, for example, fasteners extending through openings 340. The sphere 310 also may also include a second hemisphere 350 that is fixed to the first hemisphere 330 using, for example, one or more fasteners extending through the bores 360. The second hemisphere 350 includes an arcuate passageway 370. In some examples, the arcuate passageway 370 may extend into the first hemisphere 330. In other examples, the arcuate passageway 370 may be coextensive with the arcuate slot 180 of the housing 40.

Referring to FIG. 9, the carriage 320 includes a pair of annular rails 380 attached to opposite sides of the neck 190.

Each rail 380 engages a corresponding circular track 390 formed at the interior walls of the sphere 310. During operation, the rails 380 of the carriage 320 are guided along the corresponding circular tracks 390 to allow rotation of the carriage 320 within the sphere 310. When the sphere 310 is fixed with the vacuum head 40, the neck 190 and any corresponding attachments, may rotate with respect to one another in the manner shown and described in connection with FIGS. 5-7.

It will be appreciated that the foregoing disclosure provides examples of at least one example of the various manners that may be used to implement the present invention. However, it is contemplated that other implementations of the invention may differ in detail from the foregoing examples. All references to the invention or examples thereof are intended to reference the particular example being discussed at that point and are not intended to imply any limitation on the scope of the invention more generally. All language of distinction and disparagement regarding certain features is intended to indicate a lack of preference for those features, but not to exclude such from the scope of the invention entirely unless otherwise indicated.

What is claimed is:

1. An apparatus for attachment to a vacuum cleaner, the apparatus comprising:

a vacuum head, the vacuum head including:

a concave opening having a concave curvature corresponding to a convex curvature of a cylindrical surface to be vacuumed, an arcuate slot opposite to the concave opening, a circular track co-extensive with the arcuate slot, and an inlet configured to be in fluid communication with both a source of vacuum suction and the concave opening so as to provide vacuum suction to the concave opening;

a flexible conduit connected in fluid communication at a first end with the inlet of the vacuum head; and an attachment mechanism configured to swivelably support the vacuum head so as to swivel only within a central plane of the vacuum head, and configured to provide suction generated by the vacuum cleaner to the vacuum head, the attachment mechanism including:

a neck having a flange end configured to receive a source of vacuum suction, an inlet end configured to receive a second end of the flexible conduit, and at least one annular rail attached to the neck between the flange end and the inlet end, the annular rail configured to slidably engage with the circular track of the vacuum head such that movement of the annular rail along the circular track allows the neck to move through the arcuate slot of the vacuum head, thereby enabling the concave opening of the vacuum head to be supported and swiveled around the convex curvature of the cylindrical surface to be vacuumed, while the vacuum head is also moved along the length of the cylindrical surface to be vacuumed.

2. The apparatus of claim 1, wherein the flange end of the neck is configured to receive a source of vacuum suction for providing suction to the vacuum head as the vacuum head is swiveled around the convex curvature of the cylindrical surface to be vacuumed.

3. An apparatus for attachment to a vacuum cleaner, the apparatus comprising:

a vacuum head that is symmetrical about a central plane that bisects the vacuum head, the vacuum head including:

a concave opening having a curvature that generally corresponds to the convex curvature of a surface to be vacuumed, an arcuate slot opposite to the concave opening, and a circular track co-extensive with the arcuate slot;

a swivel joint having a first section with an inlet in fixed engagement with the vacuum head, the inlet configured to be in fluid communication with both a source of vacuum suction and the concave opening so as to provide vacuum suction to the concave opening, the swivel joint also having a second section that is configured to be in swivelable relationship with the first section, the swivel joint being configured to swivel only through the central plane of the vacuum head, the second section of the swivel joint including:

a neck having a flange end configured to receive a source of vacuum suction, an inlet end configured to receive an end of a flexible conduit, and at least one annular rail attached to the neck between the flange end and the inlet end, the annular rail configured to slidably engage with the circular track of the vacuum head such that movement of the annular rail along the circular track allows the neck to move through the arcuate slot of the vacuum head; and a flexible conduit extending from the first section to the second section, the flexible conduit being configured to provide suction generated by the source of vacuum suction to the vacuum head.

4. The apparatus of claim 3, wherein the neck has a second annular rail attached on an opposite side of the neck.

* * * * *